US011540676B2

(12) United States Patent
Green et al.

(10) Patent No.: US 11,540,676 B2
(45) Date of Patent: Jan. 3, 2023

(54) DISPENSER FOR ROLLED SHEET MATERIAL

(71) Applicant: Kimberly-Clark Worldwide, Inc., Neenah, WI (US)

(72) Inventors: Jonathan Green, Rossett (GB); David Reynolds, Connahs Quay (GB); Joseph E. Oberdorf, Neenah, WI (US); Michiel de Hann, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/629,148

(22) PCT Filed: Jun. 22, 2020

(86) PCT No.: PCT/US2020/038952
§ 371 (c)(1),
(2) Date: Jan. 21, 2022

(87) PCT Pub. No.: WO2021/262135
PCT Pub. Date: Dec. 30, 2021

(65) Prior Publication Data

US 2022/0248916 A1 Aug. 11, 2022

(51) Int. Cl.
*A47K 10/38* (2006.01)
*A47K 10/32* (2006.01)

(52) U.S. Cl.
CPC ..... *A47K 10/38* (2013.01); *A47K 2010/3246* (2013.01); *A47K 2010/3253* (2013.01)

(58) Field of Classification Search
CPC ..... A47K 10/22; A47K 10/38; A47K 10/426; A47K 10/3687; A47K 10/3827; A47K 10/3836; A47K 2010/3246; A47K 2010/3253
See application file for complete search history.

(56) References Cited

U.S. PATENT DOCUMENTS 5,697,576 A * 12/1997 Bloch ..... A47K 10/40 242/596.7
5,762,286 A * 6/1998 Schutz ..... A47K 10/3818 242/593
5,762,287 A * 6/1998 Schutz ..... A47K 10/3818 242/593
6,082,663 A * 7/2000 Tramontina ..... A47K 10/3818 242/593

(Continued)

FOREIGN PATENT DOCUMENTS

WO WO2018231776 12/2018

OTHER PUBLICATIONS

International Search Report and Opinion for PCT/US2020/038952 dated Oct. 8, 2020.

*Primary Examiner* — Gene O Crawford
*Assistant Examiner* — Kelvin L Randall, Jr.
(74) *Attorney, Agent, or Firm* — Dority & Manning, P.A.

(57) ABSTRACT

A dispenser for sheet materials is disclosed. The dispenser includes a housing and a front cover. The dispenser includes a first internal door configured to secure a first roll of sheet material in a dispensing position and a second internal door configured to secure a second roll of sheet material in a dispensing position. The first and second doors include first and second nozzles for dispensing sheet material. The dispenser is a centrally unwinding dispenser.

17 Claims, 8 Drawing Sheets

(56) References Cited

U.S. PATENT DOCUMENTS

| | | | | |
|---|---|---|---|---|
| 6,089,499 | A * | 7/2000 | Robinson | A47K 10/3818 242/593 |
| 6,145,782 | A * | 11/2000 | King | A47K 10/3818 242/593 |
| 6,328,246 | B1 * | 12/2001 | Hjort | A47K 10/3836 242/422.5 |
| 7,185,842 | B2 * | 3/2007 | Lewis | A47K 10/38 242/566 |
| 8,991,647 | B2 * | 3/2015 | Meyers | A61L 2/22 239/289 |
| 9,192,268 | B2 * | 11/2015 | Denis | A47K 10/3818 |
| 9,872,589 | B2 * | 1/2018 | Granger | A47K 10/3827 |
| 10,307,023 | B2 * | 6/2019 | Osborne | A47K 10/38 |
| 11,172,794 | B2 * | 11/2021 | Kim | A47K 10/3818 |
| 2006/0011772 | A1 * | 1/2006 | Lewis | A47K 10/38 242/570 |
| 2007/0290094 | A1 * | 12/2007 | Anderson | A47K 10/3836 242/594 |
| 2008/0173661 | A1 * | 7/2008 | Neveu | A47K 10/16 221/45 |
| 2008/0283546 | A1 * | 11/2008 | Neveu | A47K 10/3818 221/45 |
| 2012/0175455 | A1 | 7/2012 | Denis et al. | |
| 2019/0357736 | A1 * | 11/2019 | deLoache, III | A47K 10/3818 |
| 2020/0085248 | A1 * | 3/2020 | Rozek | A47K 10/3818 |
| 2020/0122946 | A1 * | 4/2020 | Paré | A47K 10/3836 |
| 2021/0145222 | A1 * | 5/2021 | Grosz, Jr. | A47K 10/3687 |
| 2021/0345840 | A1 * | 11/2021 | Lewis | A47K 10/36 |
| 2022/0081243 | A1 * | 3/2022 | Paré | B65H 16/021 |
| 2022/0087487 | A1 * | 3/2022 | Bagherzadeh | A47K 10/3836 |

* cited by examiner

DISPENSER FOR ROLLED SHEET MATERIAL

BACKGROUND

Washrooms in commercial and residential buildings typically include products such as toilet tissue and paper towels. Such products are typically formed in rolls and are housed by a dispenser and dispensed as needed by the user. Indeed, there are a number of dispensers capable of housing one or more rolls of material. Bathroom tissue dispensers, for example, generally include a case, in which one or more rolls of bathroom tissue are installed and dispensed through an opening. The opening is generally located along the bottom of the dispenser and the bathroom tissue can be unwound through the opening. In order to unwind the tissue, the free end of the tissue, which corresponds to the outer layer of the roll is pulled. This is known as peripheral unwinding of the paper. One of the issues concerning peripheral unwinding is that the user may withdraw a large amount of toilet tissue contributing to waste.

Other dispensers are known that allow for sheet-by-sheet unwinding of the paper from the center of the roll. Such centrally unwinding dispensers that distribute product on a sheet-by-sheet basis can reduce the amount of paper withdrawn from the dispenser, thereby eliminating product waste. However, centrally unwinding dispensers can suffer from roll collapse. For example, as sheet material is removed from the center of the roll, the roll can lose rigidity, which can cause the roll to collapse. In the case of toilet tissue, the cover must be opened several times a day in order to provide replacement rolls. Such frequent opening of the cover can also increase the risk for roll collapse.

Additionally, centrally unwinding dispensers may become jammed with product when a length of sheet material is stretched from the center of the roll. For example, many centrally unwinding dispensers include a dispensing nozzle located in the cover. Accordingly, each time the dispenser cover is opened a large length of sheet material is stretched from the roll to the front of the cover, which can lead to jamming when the cover is placed back in a closed position.

In view of the above, a need exists for a dispenser having an improved design that is functional and can be achieved at a reduced cost.

SUMMARY

In general, the present disclosure is directed to a dispenser for a sheet material, such as toilet tissue, including a housing configured to house at least one roll of sheet material, such as a first roll of sheet material and a second roll of sheet material. The dispenser also includes a first internal door and a second internal door configured to secure the first and second rolls of sheet material in a dispensing position. The first internal door and second internal door can include nozzles for removing sheet material from the first or second roll of sheet material. The dispenser includes a cover that is capable of covering the first and second rolls of sheet material and the first and second internal doors when the cover is in a closed position. The cover also includes one or more openings to allow a user to access sheet material from the first roll or second roll of sheet material.

In accordance with the present disclosure, the dispenser includes one or more internal doors capable of securing and supporting the sheet material as it is dispensed. The internal doors can be configured such that one end is pivotally attached to the base of the housing and the second end is releasably attached to the top wall of the housing. The internal doors can each have a nozzle configured thereon for dispensing the sheet material. For example, the internal door can have a roll facing side and a cover facing side with the nozzle situated on the roll facing side of the internal door. The nozzle can have a frustoconical form. The dispenser can be a centrally unwinding dispenser suitable for dispensing toilet tissue.

In some embodiments, the housing can include a base and a top wall. The base of the housing can include one or more surfaces capable of supporting a roll of sheet material. The top of the housing can also include one or more support members configured to support the rolls of sheet material when they are in a dispensing position.

In one embodiment, the dispenser includes a locking mechanism for locking the cover to the housing.

In addition to functionality, the dispenser provided herein is directed to a centrally unwinding dispenser that can be more easily maintained and manufactured at a lower cost as compared to other dispensers.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
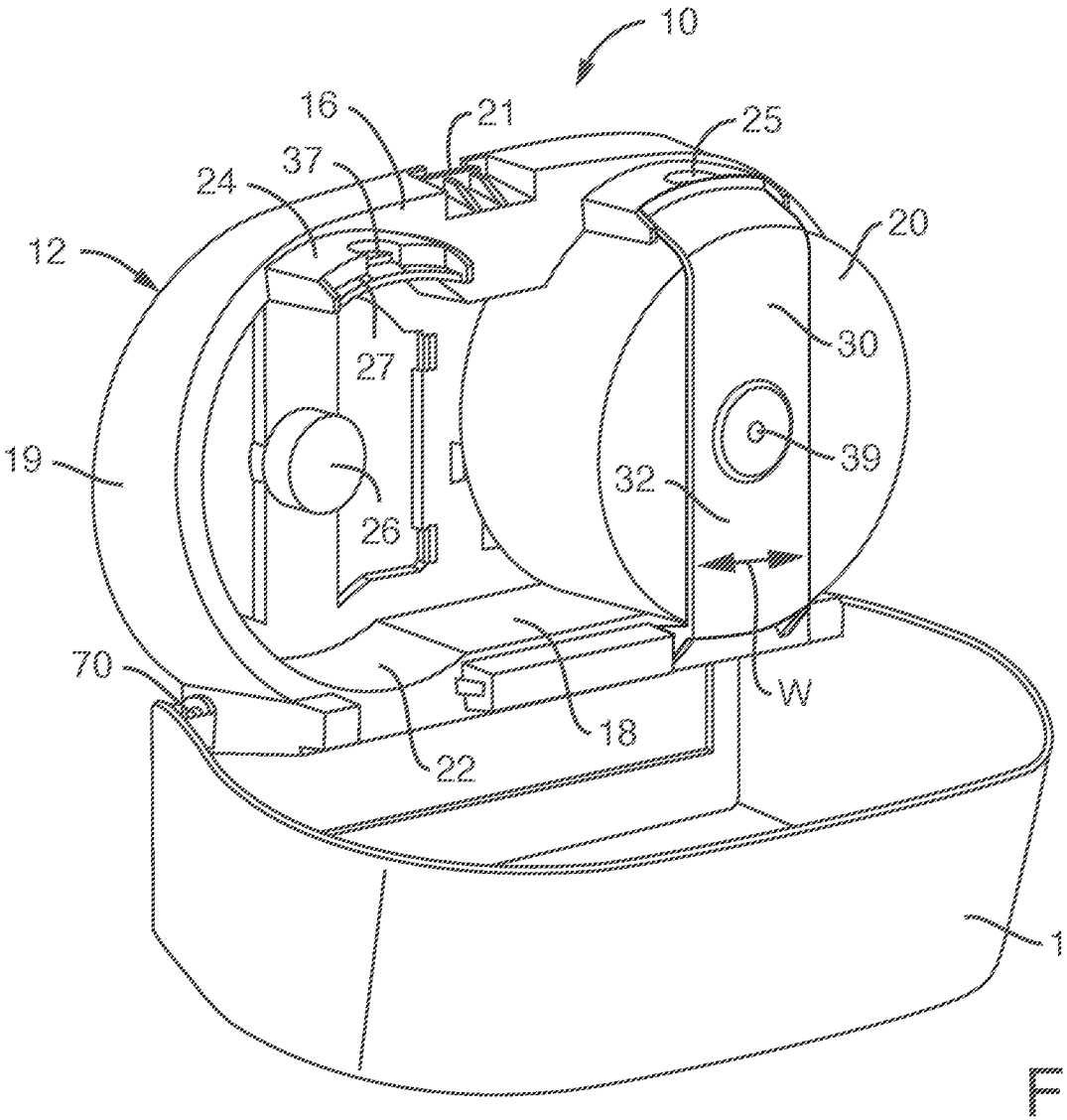
FIG. 1 is a perspective view of one embodiment of a dispenser in accordance with the present disclosure with its front cover in an open position.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, bath/toilet tissue, paper towels, wipes, label rolls, or other fibrous, film, polymers, or filamentary products.

As used herein, the term "hinge" refers to a jointed or flexible device that connects and permits pivoting or turning of a part to a stationary component. Hinges include, but are not limited to, metal or plastic pivotable connectors, such as those used to fasten a door to frame, spring-loaded hinges, living hinges, and so forth. Living hinges may be constructed from plastic and other materials and formed integrally between two members. A living hinge permits movement, such as, but not by way of limitation, pivotable movement, of one member in relation to another connected member.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors.

The present disclosure is generally directed to a dispenser for sheet materials and/or to a dispenser assembly. More particularly, the dispenser is a centrally unwinding dispenser allowing for the sheet material to be dispensed from the center of the roll rather than the periphery of the roll. Advantageously, the dispenser of the present disclosure includes one or more internal doors capable of providing roll support and reducing roll collapse. The one or more internal doors are also outfitted with a nozzle. Accordingly, the cover of the present dispenser can be opened, and the rolls of sheet material can be viewed without creating an extended length of sheet material from the center of the roll, thus reducing the risk of jamming. Furthermore, the dispenser allows for the maintenance of one roll at a time.

Referring particularly to FIGS. 1-7, various embodiments of a dispenser 10 made according to the present disclosure are illustrated. As shown particularly in FIG. 1, the dispenser 10 includes a housing 12 and a front cover 14 that can have any desired overall shape. The housing 12 can include a top wall 16 and a base 18. The housing 12 also includes a rear plate 17 and one or more sidewalls 19. The top wall 16, base 18, and sidewalls 19 extend perpendicularly from the rear plate 17, thus creating an interior capable of housing one or more rolls of sheet material 20. Components of the housing 12, specifically the top wall 16, base 18, and sidewalls 19 can be integrally formed from the same material and can be configured to have complementary dimensions corresponding to the roll of sheet material 20. For example, as shown, the side walls 19 connecting the top wall 16 and the base 18 are curved, thus facilitating the housing of one or more rolls of a roll of sheet material 20 having a curved outer periphery.

The front cover 14 can be pivotally mounted to the housing 12 using any suitable means. It will be understood that hinges, fasteners, and so forth may be used to releasably couple the front cover 14 to the housing 12. For example, in one embodiment, hinges can be used to connect the front cover 14 with the housing 12. In certain embodiments, the front cover 14 may be pivotally attached to the housing 12 via one or more pivot pins. For example, the front cover 14 can include a housing pivot surface 70 configured to engage a portion of the surface of the housing 12. The housing pivot surface 70 can be secured to the housing 12 via one or more suitable pivot pins. In such an arrangement, the front cover 14 is able to pivot from an open position to a closed position. Alternatively, the front cover 14 can be completely separable from the housing 12. In certain embodiments, the front cover 14 can define the front face, sidewalls, and top of the dispenser 10 when the front cover 14 is in a closed position. In certain embodiments, when the front cover 14 is in a closed position, the edges of the front cover are flush with the mounting surface such that the front cover 14 fully encases the housing 12 and the rolls of sheet material 20. (See FIGS. 4-5). Such configuration of the cover 14, eliminates multiple dirt traps and allows the components of the dispenser 10 to remain sanitary.

The dispenser 10 can also include any conventional locking mechanism 21 for securing the front cover 14 to the housing 12. For example, the locking mechanism 21 can include a key-hole to permit the locking mechanism 21 to be locked. Any latch and/or locking mechanism may be used to lock the front cover 14 to the housing 12 in order to prevent tampering of the internal components of the dispenser 10.

The housing 12 defines an interior volume for housing the operational components of the dispenser 10, as well as the roll or rolls of sheet material 20 to be dispensed, which can include main rolls and/or stub rolls. In embodiments, the interior volume of the housing 12 may be suitable for holding more than one roll of material. For example, the interior volume of the housing 12 may be suitable for holding two or more rolls of material. As shown in FIG. 1, the housing 12 has a first roll of sheet material 20 disposed in a dispensing position with the internal door 30 in closed position. The second dispensing position does not contain a roll of sheet material. The interior of the housing 12 can include at least two circular housings generally configured to engage the periphery of a roll of sheet material 20 and hold the roll in place. For example, in embodiments, portions of the interior of the housing 12 can be formed in a circular or curved manner in order to accommodate cylindrical rolls of material. Specifically, at least a portion of the base 18 can form a roll holder surface 22 configured to support a roll of sheet material 20. As shown, the shape of the roll holder surface 22 generally corresponds to the curvature and size of the desired roll of sheet material. Accordingly, as shown in FIG. 1, when a roll of sheet material 20 is placed in the housing 12 in dispensing position, the roll holder surface 22 can provide support to the roll of sheet material 20.

Additionally, the housing 12 can also include one or more roll support members 24. The housing 12 can include a first roll support member configured to support a first roll of sheet material and a second roll support member configured to support a second roll of sheet material. For example, the top wall 16 of the housing 12 can include one or more roll support members 24 configured to hold or support the roll of sheet material 20. As shown the roll support members 24 can include a generally curved surface for engaging a portion of the periphery of the roll of sheet material 20. Thus, the one or more support members 24 can provide support to the periphery of the roll of sheet material 20.

The support member 24 can further include an internal door engagement surface 27 configured to engage a surface of the internal door 30 when the internal door 30 is in a closed position. The support member 24 and internal door 30 can be configured with a latching mechanism 25 configured to releasably secure the internal door 30 to the support member 24. In embodiments, the latching mechanism 25 is a releasable latching mechanism allowing the internal door 30 to be released from the support member 24 so that a used roll of sheet material can be replaced. In certain embodiments, the latching mechanism 25 can be a configured such that when force is applied by the user, the connection between the internal door 30 and the support member 24 of the housing 12 is released. The latching mechanism 25 can include any suitable latch or clip. Specifically, in certain embodiments, the internal door 30 can include a hook 33 configured to engage a rod 37 on the support member 24. The hook 33 is configured such that it can be snapped or clipped into engagement with the rod 37, thereby securing the internal door 30 to the support member 24.

The housing 12 can also be configured with one or more central roll support members 26 configured to support the center of the roll of sheet material 20 when the sheet material 20 is in dispensing position. For example, the central roll support member 26 can be a cylindrical protrusion extending from the rear plate 17 of the housing 12 configured to engage the center of the roll of sheet material 20. In order to dispense material from the roll of sheet material 20, the core of the roll of sheet material 20 must be removed so that the sheet material can be centrally unwound from roll. The removal of the core from the roll of sheet material 20 can negatively affect the dimensional stability of the roll of sheet material 20. As such, the central roll support member 26 can provide additional support and stability to the core of the roll of sheet material 20.

The dispenser 10 and housing 12 are configured to hold at least two rolls of sheet material 20. The housing 12 can be configured such that at least two rolls of sheet material 20 are housed in a horizontal position in the dispenser 10. The rolls of sheet material 20 can be placed within the housing 12 such that the roll holder surface 22 and the roll support member 24 engage the periphery of the roll of material. The rolls of sheet material 20 can be positioned in the dispenser 10 such that each roll of sheet material 20 is mounted with its outer perimeter adjacent to the other. One flat end of each roll of sheet material 20 is positioned adjacent to the rear plate 17 of the housing 12, while the opposite flat end of each roll of sheet material 20 is positioned adjacent to the internal door 30 and front cover 14, when the internal door 30 and front cover 14 are in a closed position. Furthermore, the rolls of sheet material 20 are positioned in the dispenser 10 such that when inside the housing 12, the rolls of sheet material 20 do not turn on their axes.

Figure 2:
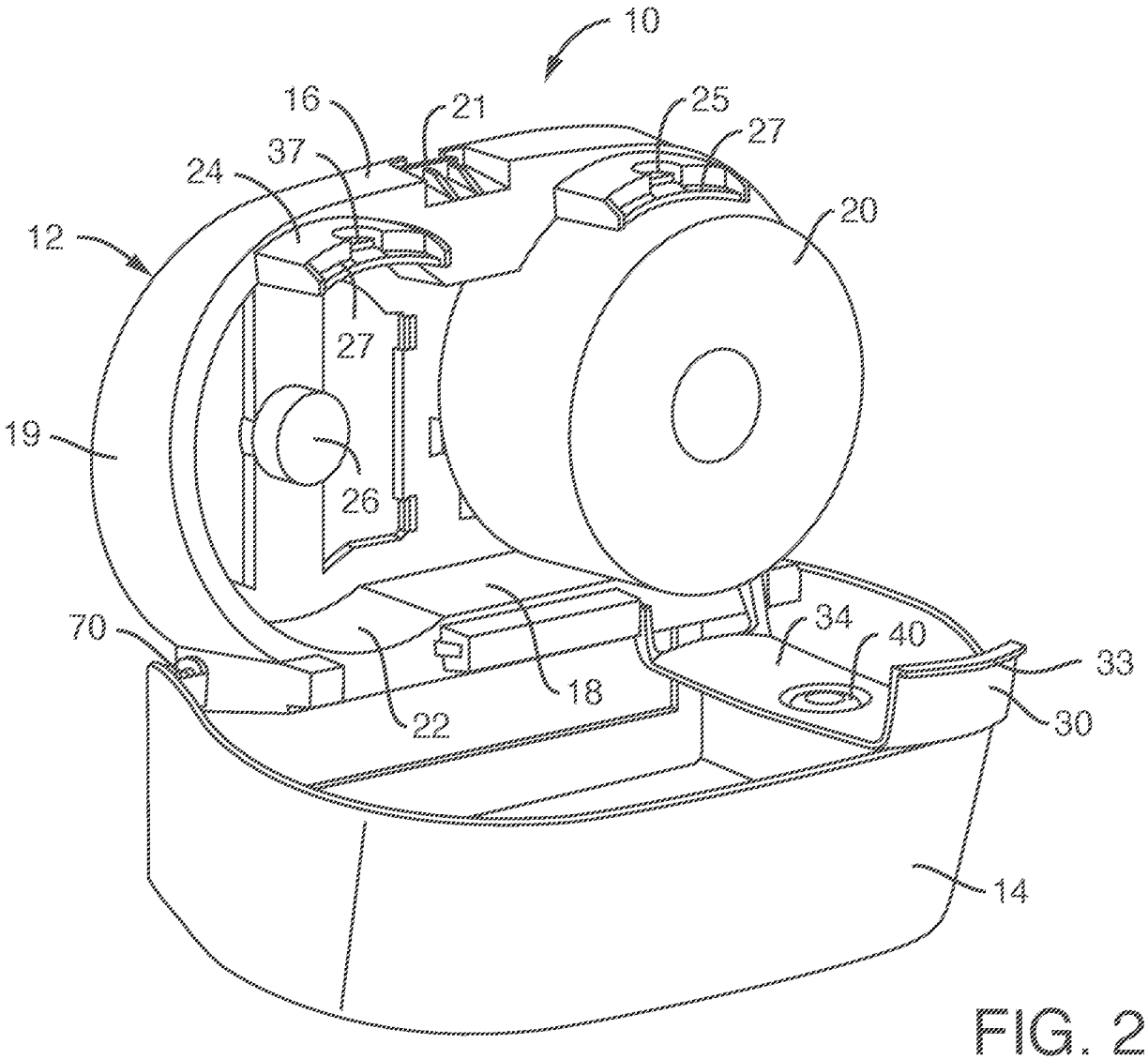
FIG. 2 is a perspective view of one embodiment of a dispenser in accordance with the present disclosure with its front cover in an open position.
Figure 3:
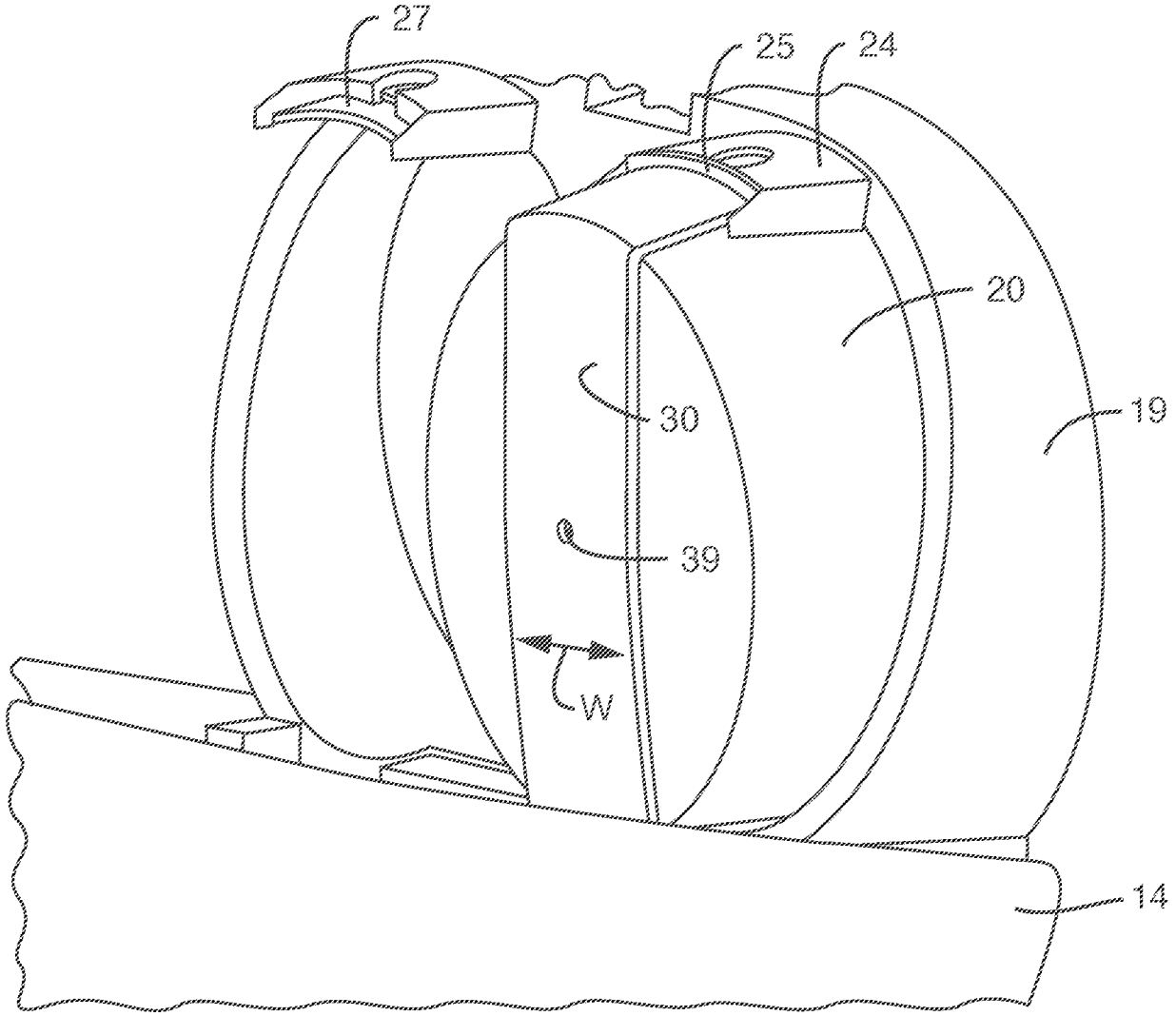
FIG. 3 is a perspective view of one embodiment of a dispenser in accordance with the present disclosure with its front cover in an open position.

The dispenser 10 includes one or more internal doors 30 configured to support a roll of sheet material 20 in a dispensing position. FIG. 1 shows an internal door 30 in a closed position, while FIG. 2 shows the internal door 30 in an open position. In two-roll embodiments, the dispenser 10 can include a first internal door 30 configured to support a first roll of sheet material 20 and a second internal door configured to support a second roll of sheet material (not shown). The internal door 30 is configured to the housing 12 such that when the front cover 14 is in closed position, the internal door 30 is covered by the front cover 14. Accordingly, in embodiments the dispenser 10 includes a first internal door and a second internal door that are both covered by the front cover 14 when the front cover 14 is in a closed position.

In embodiments, one end of the internal door 30 can be pivotally connected to the housing 12 using any suitable means. For example, it will be understood that hinges, fasteners, and so forth may be used to couple at least one end of the internal door 30 to the housing 12. For example, in one embodiment, hinges can be used to connect the internal door 30 with the housing 12. In certain embodiments, the internal door 30 may be pivotally attached to the housing 12 via one or more pivot pins. In such an arrangement, the internal door 30 is able to pivot from an open position to a closed position. Alternatively, the internal door 30 can be completely separable from the housing 12 (not shown).

The internal door 30 can generally include a cover facing surface 32 and a roll facing surface 34. As shown, the internal door 30 can be configured to provide support to hold the roll of sheet material 20 in a dispensing position. For example, the internal door 30 can include a roll facing surface 34 that generally spans the diameter of the roll of sheet material 20 and further secures the roll of sheet material 20 in the dispenser 10. The internal door 30 can also contain a curved portion configured to engage the periphery of the roll of sheet material 20, thereby further securing the roll of sheet material 20 in the dispenser 10. In certain embodiments, the internal door 30 has a width W that is smaller than the roll of sheet material 20. For example, in certain embodiments the internal door 30 has a width of from about 49 mm to about 150 mm, such as from about 50 mm to about 125 mm, such as from about 65 mm to about 120 mm, such as from about 70 mm to about 110 mm, such as from about 80 mm to about 100 mm.

Figure 8:
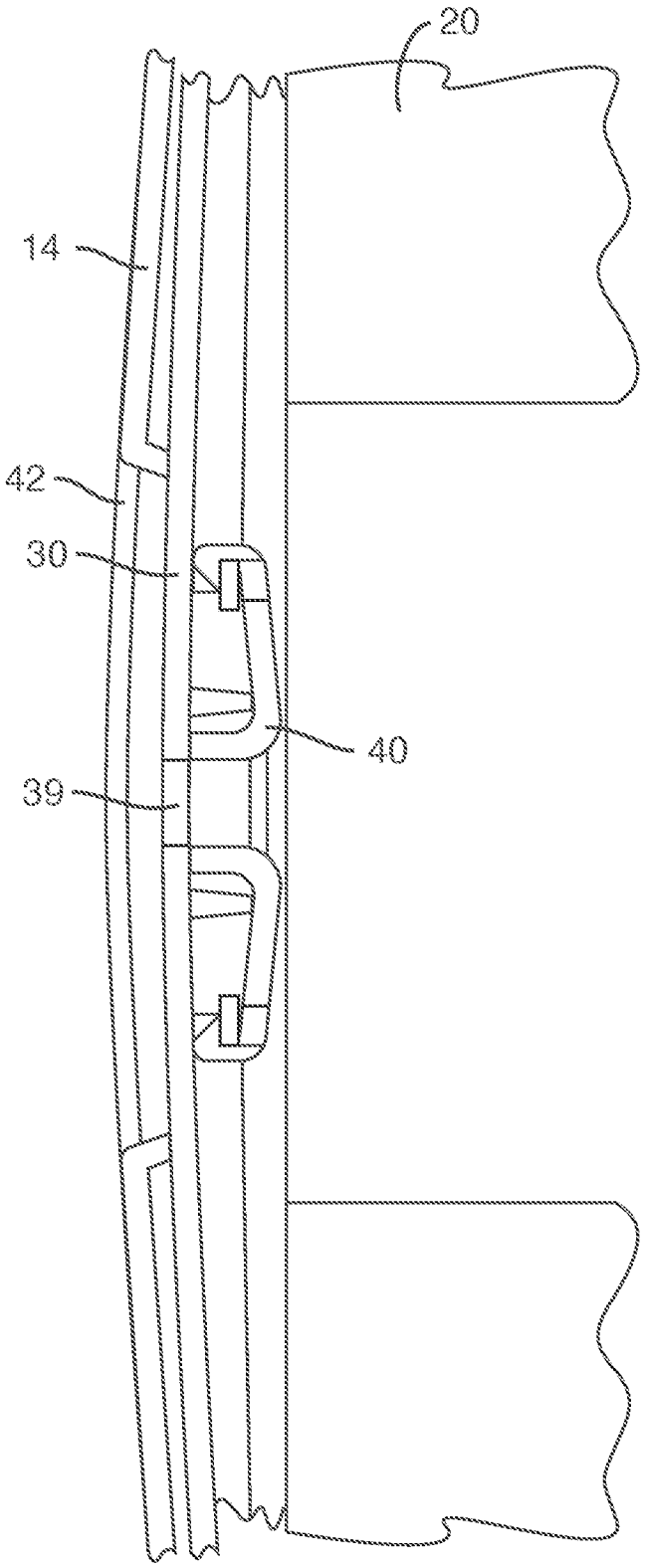
FIG. 8 is a cross section view of one embodiment of a dispenser in accordance with the present disclosure.

The internal door 30 can also be configured to have a recessed portion 35 in the roll facing surface 34, which corresponds to a raised portion 36 about the cover facing surface 32 of the internal door 30. The placement of the recessed portion 35 on the internal door 30 is such that when the internal door 30 is in a closed position, the recessed portion 35 is generally in line with the center axis of the roll of sheet material 20. The recessed portion 35 can generally provide a concave area on the roll facing surface 34 of the internal door 30, which forms a convex portion or raised portion 36 on the cover facing surface 32 of the internal door 30. The size and shape of the recessed portion 35 can be configured such that a nozzle 40 can be housed within the recessed portion 35. For example, in certain embodiments the recessed portion 35 is configured to house a nozzle 40 such that no portion of the nozzle 40 extends into the center of the roll of sheet material 20 when the internal door 30 is in a closed position. (See FIGS. 7 and 8). Accordingly, the recessed portion 35 can be configured such that the nozzle 40 is contained within the recessed portion 35 and does not extend laterally out from the roll facing surface 34 of the internal door 30.

The internal door can also include a opening 39 so that sheet material from the roll of sheet material 20 can be removed from the nozzle 40. The nozzle 40 may have a frustoconical form. Further, the nozzle 40 may have an opening of a circular, triangular, rectangular or pear shape. The nozzle 40 can have a truncated shape, that is the nozzle 40 has a smaller-diameter orifice being the exit orifice, or dispensing orifice located on the side of the nozzle distal to the roll of sheet material 20. In embodiments, the nozzle 40 may have one or more tearing members suitable for tearing sheet material from the roll of sheet material 20. The nozzle 40 can be connected to the internal door 30 via any suitable mechanism. For example, the internal door 30 can have one or more flanges configured to lock the nozzle 40 in place. In other embodiments, the nozzle 40 can be fastened to the internal door 30 via any suitable fastener. Furthermore, the nozzle 40 can be removably coupled to the internal door 30 such that the nozzle 40 can be removed.

The components of the dispenser 10, such as the internal door 30 and the nozzle 40 can be configured such that they can be readily removable from the housing 12 for servicing and/or replacing without the necessity of having to remove the entire dispenser 10 its support surface. For example, the nozzles 40 are easily accessible and can be removed from the internal door 30. Accordingly, each individual nozzle 40 can be replaced without having to replace the entire internal door 30 or without having to replace the front cover 14.

Figure 4:
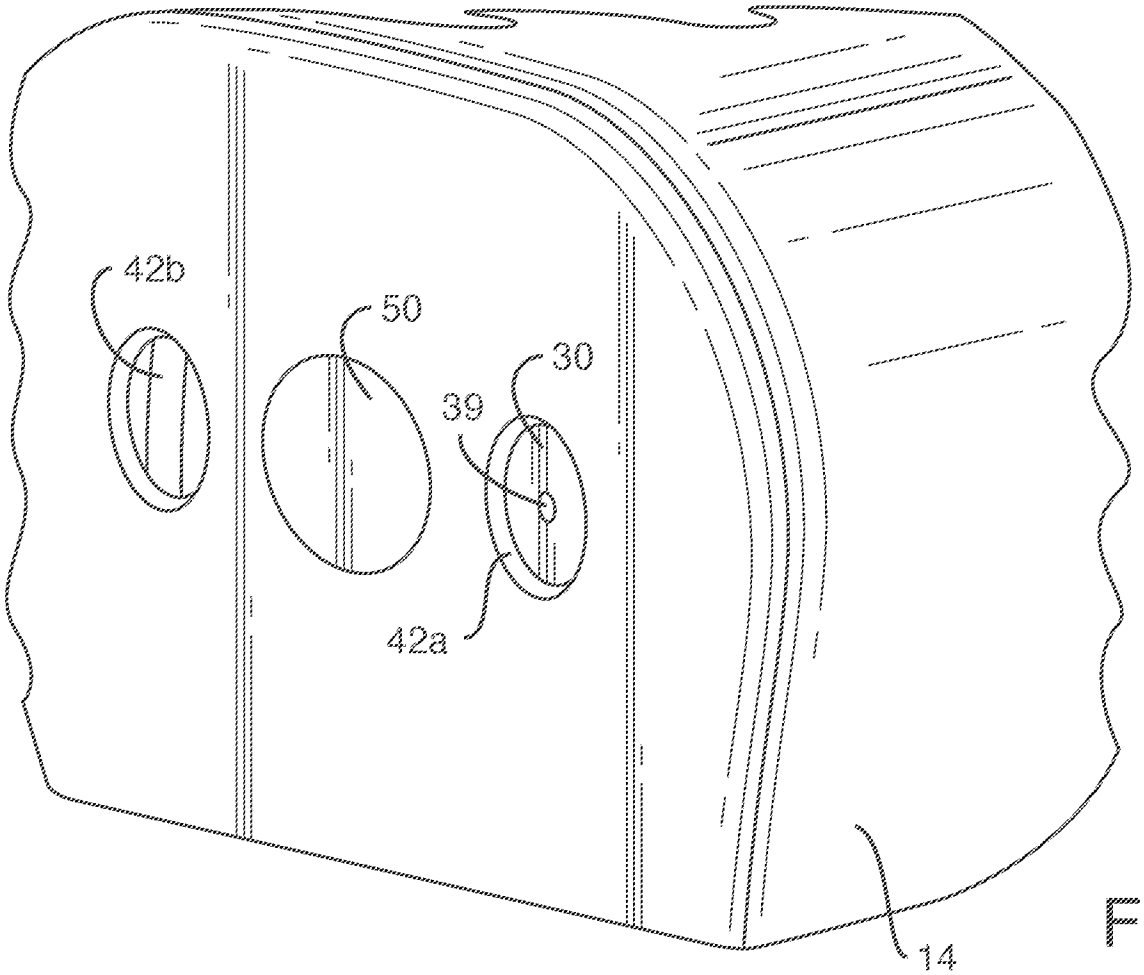
FIG. 4 is a perspective view of one embodiment of a dispenser in accordance with the present disclosure with its front cover in a closed position.
Figure 5:
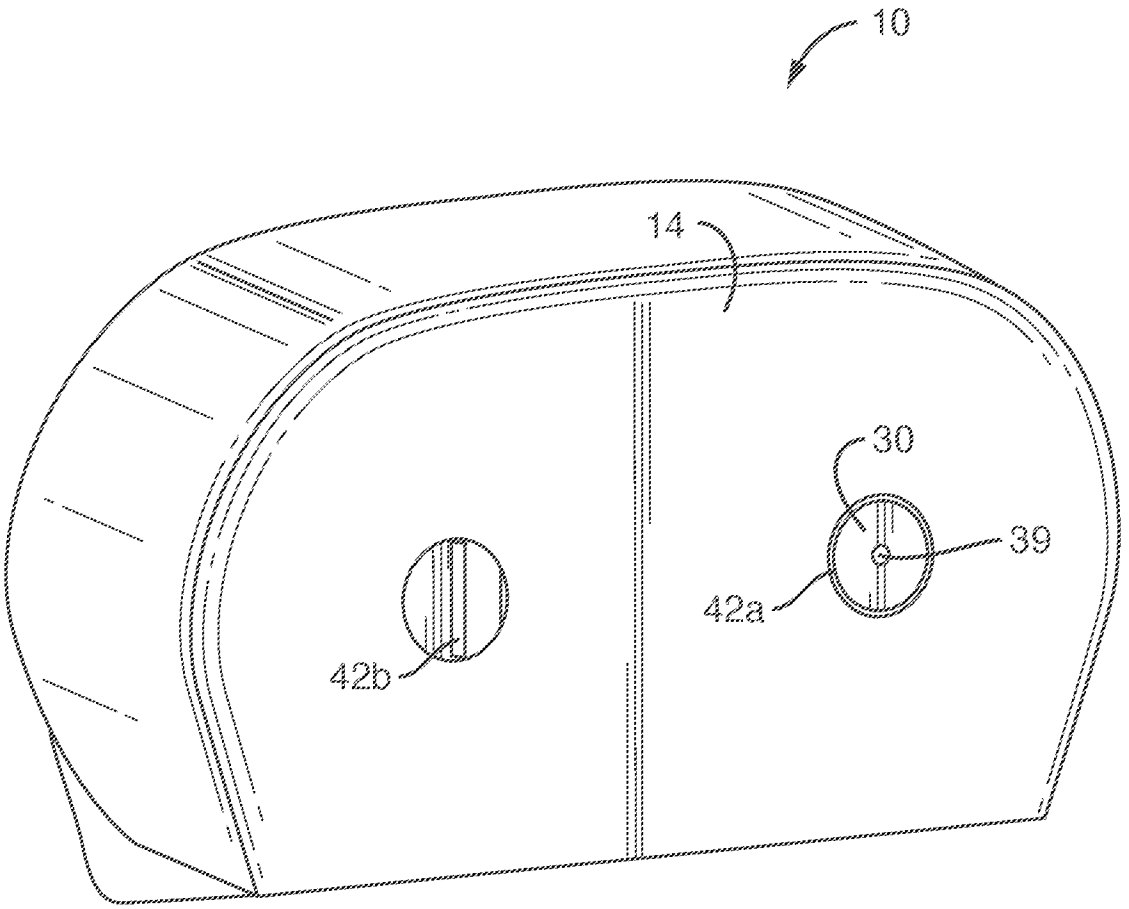
FIG. 5 is a perspective view of one embodiment of a dispenser in accordance with the present disclosure with its front cover in a closed position.

The front cover 14 also includes one or more access openings 42 such that product can be removed from the dispenser 10. In embodiments, the front cover 14 includes a first access opening 42*a* for dispensing sheet material from a first roll of sheet material and a second access opening 42*b* for dispensing sheet material from a second roll of sheet material. The access opening 42 can be configured such that when the internal door 30 is in a closed position, the raised portion 36 of the internal door 30 fits within the access opening 42 on the front cover 14. For example, as shown in FIGS. 4-5 the raised portion 36 of the internal door 30 fits within the access opening 42*a*. In certain embodiments, the raised portion of the internal door 30 can fit flush within the access opening 42 such that no portion of the internal door 30 extends laterally out from the surface of the front cover 14. In embodiments, the shape of the access opening 42 corresponds to the shape of the raised portion 36 on the internal door 30.

In certain embodiments, the front cover 14 can include a window 50 such that when the front cover 14 is in a closed position, the rolls of sheet material 20, such as the periphery of the rolls of sheet material 20 are viewable through the window 50. The window 50 may be open, or may be constructed of a transparent or translucent material that permits viewing of the interior of the dispenser.

Figure 6:
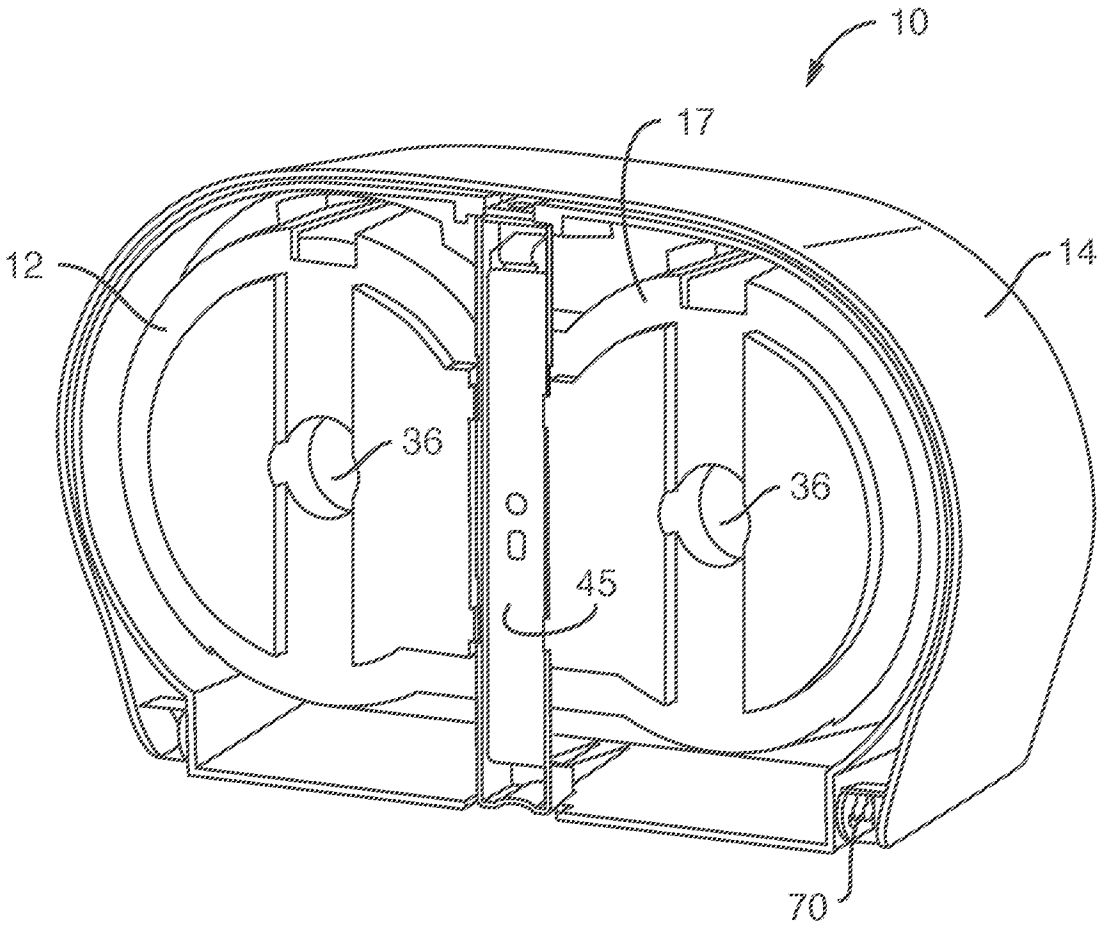
FIG. 6 is a perspective view of the rear of one embodiment of a dispenser in accordance with the present disclosure.
Figure 7:
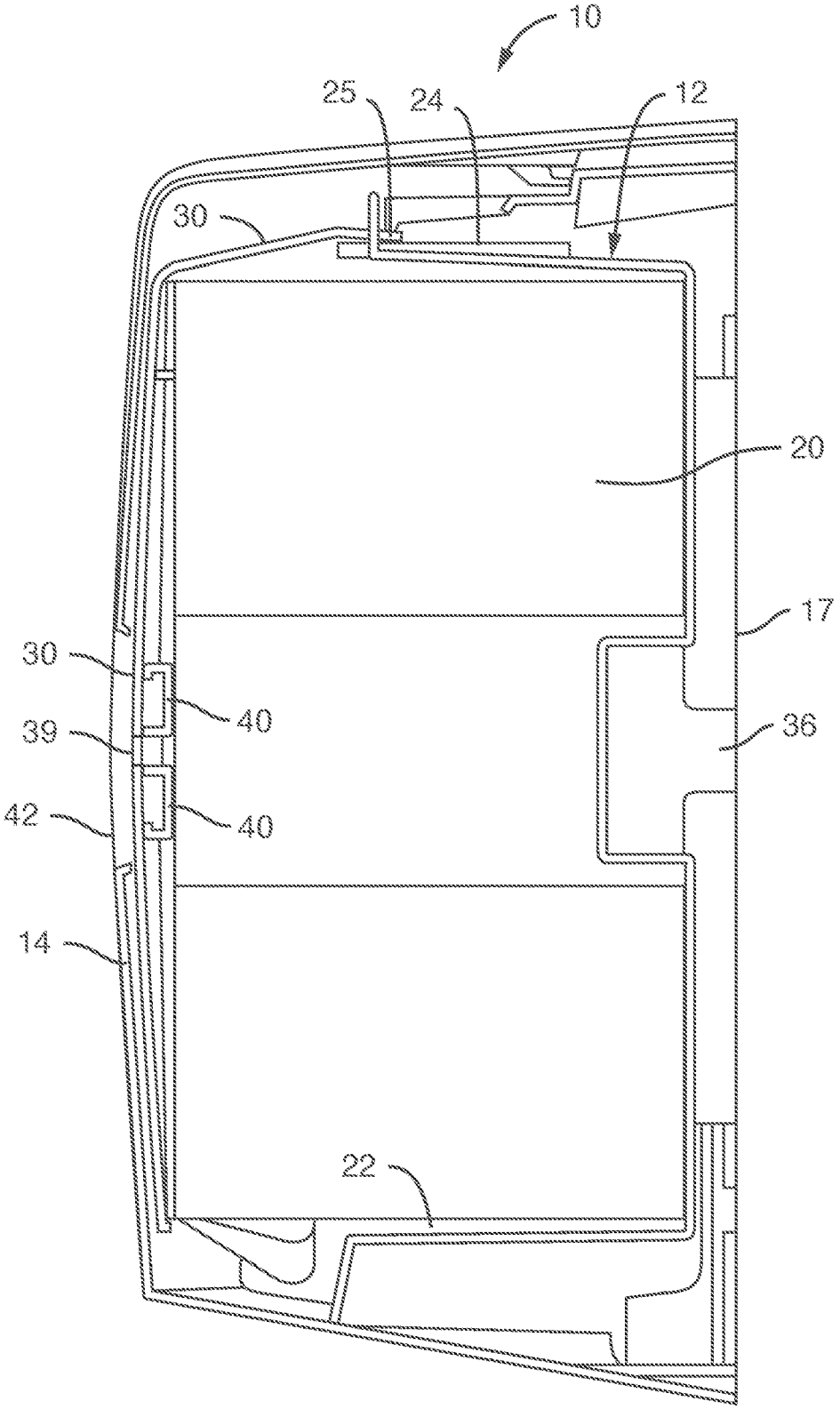
FIG. 7 is a cross section view of one embodiment of a dispenser in accordance with the present disclosure.

Referring now to FIG. 6, the housing 12 can include an attachment mechanism 45 on the side of the rear plate 17 that faces the mounting surface. The attachment mechanism 45 can include any mechanism capable of securing the dispenser 10 to a mounting surface, such as a wall or the wall of a stall in a bathroom. In embodiments, the attachment mechanism 45 can include an aperture or slot configured to engage a bracket that is mounted on the mounting surface. The attachment mechanism 45 can be compatible with any suitable fastener for securing the dispenser 10 to a mounting surface.

In embodiments, the roll of sheet material 20 can include sheet material having at least one plie. The sheet material can have at least two plies or at least three plies that are connected together by any appropriate mechanical or chemical means in a manner well know to a person skilled in the art. The sheet material can be wound on a roll, the roll having a central internal core. Cores for sheet materials are known and generally are cylindrical tubes formed from paperboard or other suitable materials. Here, the core of the sheet material is removed such that the roll can be placed in a dispensing position in the dispenser 10. In certain embodiments, the roll of sheet material 20 can be a roll of toilet tissue paper.

The sheet material can be perforated or partially cut such that certain individual sized sheets of material can be removed from dispenser 10 on a sheet-by-sheet basis. For dispensing sheets of material from the roll of sheet material 20, the free end of the sheet material from the center of the roll of sheet material 20 is inserted into the nozzle 40 such that a portion of the sheet material projects out from the nozzle and through the opening 39 of the internal door 30. The user is then able to pull on the end of the sheet material projecting from the nozzle 40 to remove a sheet of material. As the user removes sheet material, the roll of sheet material 20 unwinds from the center of the roll. To this end, generally the force of extraction of the sheet material out of the nozzle 40 should be greater than the force of the tearing of the perforation that holds together two adjacent sheets of material. Thus, as the user unwinds the sheet material, when the next perforation comes out of the nozzle 40 the sheet material being pulled by the user separates from the next sheet before this latter sheet fully exits nozzle 40. The next sheet then projects from the nozzle 40 and can in turn be unwound. Accordingly, individual sheets can be delivered via the nozzle 40 on a sheet-by-sheet basis.

The sheet material can be a strip of material, such as a strip of paper material, having perforations transverse to the strip, thus defining rectangular paper sheets. Such sheets generally have a width that is transverse and a length that is longitudinal. For example, the roll of sheet material 20 can be perforated such that sheets having a length of from about 200 mm to about 300 mm can be removed from the dispenser 10. For example, in certain embodiments each individual sheet may have a length of from about 200 mm to about 300 mm, such as from about 210 mm to about 290 mm, such as from about 220 mm to about 280 mm, such as from about 230 mm to about 270 mm, such as from about 240 mm to about 260 mm, such as from about 245 mm. Furthermore, the sheet material can be configured to have a width of about 80 mm to about 130 mm, such as from about 90 mm to about 110 mm, such as about 100 mm to about 110 mm. Accordingly, each individual sheet can have a width to length ratio of from about 0.2 to about 0.8, such as about 0.4 to about 0.5. In certain embodiments, each sheet can have a width to length ratio of less than 0.5, such as less than 0.45, such as less than 0.4.

The dispenser 10 of the present embodiment can be configured to hold a combination of large, medium, and small rolls, in non-limiting combinations. For example, in embodiments the dispenser 10 can be configured to hold two jumbo rolls of material. As used herein, "jumbo roll" of material refers to a roll having a diameter of from about 150 mm to about 300 mm. In certain embodiments, the roll of sheet material has a diameter of from about 140 mm to about 250 mm, such as from about 150 mm to about 240 mm, such as from about 160 mm to about 230 mm, such as from about 180 mm to about 220 mm, such as from about 190 mm to about 210 mm.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for sheet materials comprising:

a housing configured to house a first and second roll of sheet material, the housing having a base and a top wall, wherein the top wall comprises a first roll support member configured to support the first roll of sheet material in dispensing position and a second roll support member configured to support the second roll of sheet material in dispensing position;

a first internal door configured to secure the first roll of sheet material in a dispensing position, wherein the first internal door includes a first dispensing nozzle for removing sheet material from the first roll of sheet material;

a second internal door configured to secure the second roll of sheet material in a dispensing position, wherein the second internal door includes a second dispensing nozzle for removing sheet material from the second roll of sheet material; and a front cover being configured in a closed position to cover the first and second rolls of sheet material and the first and second internal doors, wherein the cover includes one or more apertures to allow a user to access sheet material from the first roll of sheet material or the second roll of sheet material, wherein the first roll support member and the first internal door are configured with a latching mechanism configured to releasably attach a second end of the first internal door to the first roll support member, and wherein the second roll support member and second internal door are configured with a latching mechanism configured to releasably attach a second end of the second internal door to the second roll support member.

2. The dispenser of claim 1, wherein a first end of the first internal door is pivotally attached to the housing and a first end of the second internal door is pivotally attached to the housing.

3. The dispenser of claim 1, wherein at least a portion of a surface of the base forms a first roll support surface for supporting the first roll of material in dispensing position, and wherein at least a portion of a surface of the base forms a second support surface for supporting the second roll of sheet material in dispensing position.

4. The dispenser of claim 1, wherein the housing includes one or more central roll support members configured to support the first or second roll of sheet material in dispensing position.

5. The dispenser of claim 1, wherein the first internal door includes a roll facing side and a cover facing side, wherein the roll facing side includes recessed portion for housing the first nozzle, and wherein the first nozzle is housed in the recessed portion such that no portion of the nozzle extends laterally from the roll facing side of the first internal door.

6. The dispenser of claim 1, wherein the second internal door includes a roll facing side and a cover facing side, wherein the roll facing side includes recessed portion for housing the second nozzle, and wherein the second nozzle is housed in the recessed portion such that no portion of the nozzle extends laterally from the roll facing side of the first internal door.

7. The dispenser of claim 1, wherein the first and second nozzle have a frustoconical form.

8. The dispenser of claim 1, wherein the front cover includes one or more access openings for removing sheet material from the roll of sheet material.

9. The dispenser of claim 1, wherein the dispenser is a centrally unwinding dispenser.

10. The dispenser of claim 1, wherein the dispenser includes a locking mechanism for locking the front cover to the housing.

11. The dispenser of claim 1, wherein the first and second rolls of sheet material comprise rolls of toilet tissue.

12. The dispenser of claim 1, wherein the first and second rolls of sheet material each have a diameter of from about 140 mm to about 250 mm.

13. The dispenser of claim 1, wherein the housing includes an attachment mechanism for mounting the dispenser to a mounting surface.

14. The dispenser of claim 1, wherein the front cover includes a window configured such that both the first roll of sheet material and the second roll of sheet material are viewable when the front cover is in a closed position.

15. The dispenser of claim 1, wherein individual sheets of material are removed from the roll of sheet material on a sheet-by-sheet basis.

16. The dispenser of claim 1, wherein the roll of sheet material comprises perforated sheet material.

17. The dispenser of claim 16, wherein each individual sheet has a width to length ratio of about 0.45 or less.

* * * * *